US005798486A

United States Patent [19]

Elsinger et al.

[11] Patent Number: 5,798,486

[45] Date of Patent: Aug. 25, 1998

[54] CASING FOR A JUNCTION IN A FLAT CABLE

[75] Inventors: Herbert Elsinger, Holzkirchen; Johannes Oberndorfer, Miesbach; Friedrich Plappert, Holzkirchen, all of Germany

[73] Assignee: Euro-Matsushita Electric Works Aktiengesellschaft, Holzkirchen, Germany

[21] Appl. No.: 763,293

[22] Filed: Dec. 10, 1996

[30] Foreign Application Priority Data

Dec. 14, 1995 [DE] Germany ..... 195 46 781.7

[51] Int. Cl.[6] ..... H01R 4/10

[52] U.S. Cl. ..... 174/92; 174/97; 174/117 F

[58] Field of Search ..... 174/72 TR, 92, 174/97, 91, 117 F

[56] References Cited

U.S. PATENT DOCUMENTS

| | | | |
|---|---|---|---|
| 4,744,010 | 5/1988 | Witte | 174/97 X |
| 4,781,255 | 11/1988 | Lock et al. | 174/97 |
| 5,045,000 | 9/1991 | Trame et al. | 174/92 X |
| 5,138,528 | 8/1992 | Altman et al. | 361/400 |
| 5,571,985 | 11/1996 | Ritter et al. | 102/217 |

FOREIGN PATENT DOCUMENTS 44 33 880 8/1995 Germany .

*Primary Examiner*—Bot L. Ledynh
*Assistant Examiner*—Marc D. Machtinger
*Attorney, Agent, or Firm*—Foley & Lardner

[57] ABSTRACT

A casing 14 for a junction included in a flat cable 10, e.g. for a trigger stage of a sequential blasting system, consists of two casing portions 12, 13 adapted to be fixed to each other by screwing within the lead-through regions of the cable. The casing portions 12, 13 constitute cramping areas for fixing the cable 10 to the casing 14 in a direct, non-positive way, wherein the screws 23 which interconnect the two casing portions 12, 13 at the same time create the cramping pressure. An additional positive engagement between the cable 10 and the casing 14 is achieved by engagement between a tube 25 which receives the screw 23 and a hole 29 provided in a center web 28 of the cable. Tensile strain occurring within the cable 10 is thus diverted via the casing 14 around the electrical equipment provided in the casing and soldered to the wires 19 of the cable 10. Even under high tensile forces, the soldering points are thus not exposed to any strain.

12 Claims, 2 Drawing Sheets

CASING FOR A JUNCTION IN A FLAT CABLE

BACKGROUND OF THE INVENTION

In mining, blasting systems are used for sequentially triggering explosive charges placed in bore holes at a working face. Each explosive charge is ignited by an associated trigger stage, and all trigger stages are connected in cascade with a pulse source via a control line. The control line often takes the form of a flat cable usually including four wires; some circuits require only three or even only two wires. Examples for such sequential blasting systems are described in U.S. Pat. No. 5,571,985 and German Patent No. 4,433,880.

Flat cables of this type, which have trigger stages inserted at intervals, are occasionally exposed to considerable tensile strain resulting from rough working conditions, particularly when used in underground mining. As an example, when a cable has become caught or jammed, the worker will try to release it by violent, jerky pulls. It is essential that such tensile forces be prevented from causing interruptions of the control line within the areas where it connects to the trigger stages.

SUMMARY OF THE INVENTION

It is an object of the invention to provide an efficient strain relief for a junction provided in a flat cable.

This object is met by a casing for a junction disposed in a flat cable, including two casing portions adapted to be fixed to each other and cooperating to form lead-through regions for the cable, each lead-through region providing a cramping region for engaging the cable and securing the casing directly to the cable.

According to the invention, the casing which receives the electrical components of the junction is structured such that tensile forces exerted on the cable are transmitted directly to the casing itself at the locations where the cable enters and exits from the casing. At each junction, the tensile forces are thus diverted through the casing, thereby removing the strain from the electrical circuit components which are received within the casing and electrically connected, usually by soldering, to the wires of the cable.

In an embodiment of the invention, the two casing portions are adapted to be fixed to each other by screws which penetrate the cramping regions. This results in the advantage that the screws which serve to fix the casing portions to each other at the same time generate the cramping pressure to be exerted on the cable.

In another embodiment, one of the casing portions includes screw receiving tubes, each screw passing through a first hole provided in the other casing portion, a second hole provided in a web of the cable and engaging a respective one of the screw receiving tubes. It is an advantage achieved by this structure forces exerted on the cable are transmitted to the casing also by positive engagement between the cable and the casing, without requiring additional manufacturing or connecting measures.

Preferably, the hole provided in the other casing portion has an enlarged portion for receiving an end portion of the respective screw receiving tube. Any tensile forces are thus transmitted symmetrically to both casing portions. The enlarged portion may be so provided that it forms an abutment for an end face of the screw receiving tube, thereby achieving a limitation of the cramping forces exerted directly on the cable.

In another preferred embodiment, each cramping region has grooves formed in at least one of the casing portions for accommodating wires of the cable, each groove having a shallow portion in the vicinity of the screw. The insulation surrounding the wires of the cable is thus pinched through, so that the wires are cramped directly, and even high tensile forces are prevented from being transmitted to those locations where the wires are connected to the electrical circuit enclosed the casing.

Preferably, the shallow portion terminates inside the casing at an edge extending transversely to the longitudinal direction of the cable. Accordingly, when very high tensile forces occur, this edge will cause the insulation of the cable to dam up behind the edge, thereby further resisting any transmission of strain into the interior of the casing.

The casing preferably has an outer profile free of surfaces extending transversely to the longitudinal direction of the cable to reduce the danger of the casing becoming caught at obstructions when pulling the cable.

In a further embodiment of the invention, a printed circuit board is placed within the casing in a positively engaging manner, the cable being fixed to the board and having a bent portion situated between each cramping region and the location where it is fixed to the board. This results in the additional advantage that small displacements of the cable relative to the cramping regions of the casing do not result in strain on the connections of the wires to the electrical circuit enclosed in the casing.

In accordance with yet another embodiment, internal spacer elements are formed inside the casing portions which have with ends contacting each other directly or via the Printed Circuit board. The casing is thereby made very highly stable also transversely to the longitudinal direction of the cable.

BRIEF DESCRIPTION OF THE DRAWINGS

A preferred embodiment of the invention will now be explained with reference to the drawings, in which.

DETAILED DESCRIPTION OF A PREFERRED EMBODIMENT

Figure 1:
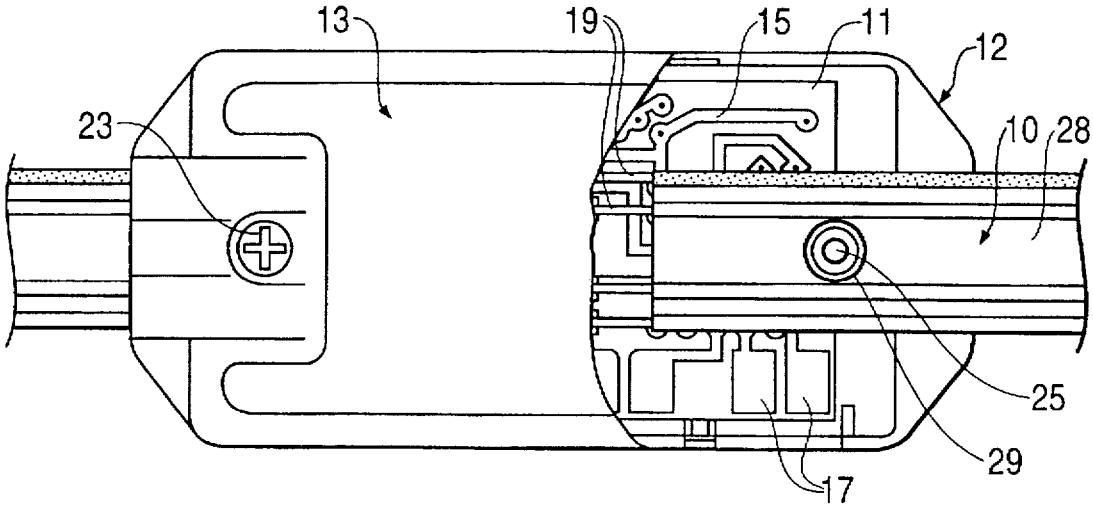
FIG. 1 is a plan view of a casing disposed in a flat cable and containing a junction electrically connected to the cable, with the upper casing portion shown partly broken away.
Figure 2:
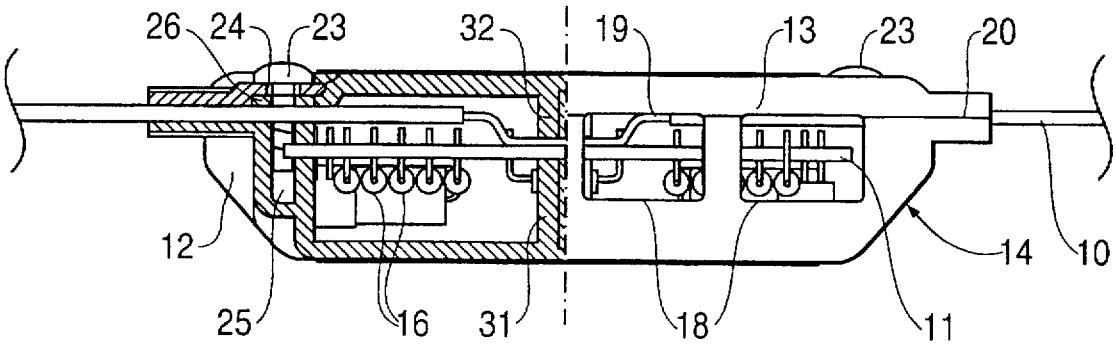
FIG. 2 is a side view of FIG. 1, with the left half shown in section.

As shown in FIGS. 1 and 2, the junction which is provided in a flat cable 10 and which may constitute a trigger stage of a sequential blasting system, consists of an electrical circuit disposed on a printed circuit board 11 received within a casing 14 consisting of a lower casing portion 12 and an upper casing portion 13.

The printed circuit board 11 is provided at its upper side with a conductor pattern 15 and carries at its lower side the circuit components, indicated at 16, of the junction. At a longitudinal side, the conductor pattern 15 has terminal pads 17 for contacting a trigger plug connector (not shown) which is connected to an explosive charge (not shown either) and which may be inserted into the casing 14 through a lateral opening 18.

Figure 5:
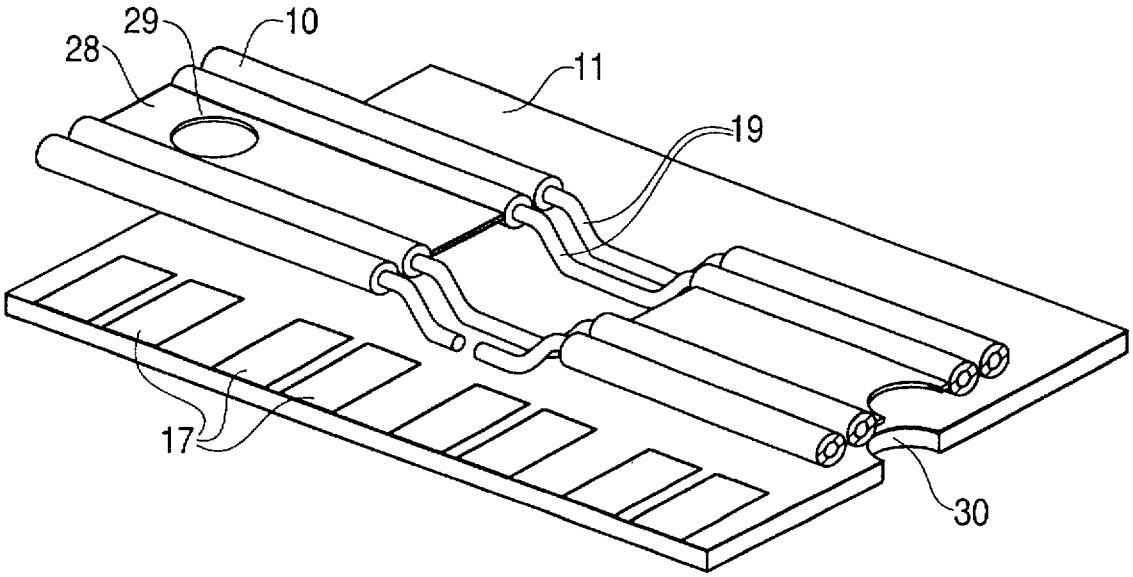
FIG. 5 is a perspective view of the electrical equipment in the form of a printed circuit board with a portion of the cable connected thereto.

As schematically shown in FIG. 5, a portion of the flat cable 10 located inside the casing 14 is stripped of its insulation, and the thus bared wires 19 are soldered to points of the conductor pattern 15 (not shown in detail) provided on the printed circuit board 11.

As illustrated in FIG. 2, the circuit board 11 is disposed in the lower casing portion 12 in a plane below the location where the cable 10 enters the casing 14. As shown also in FIG. 5, the cable 10, or the bare portions of the wires 19, are provided with two opposite bends on both sides of the soldering points.

Figure 3:
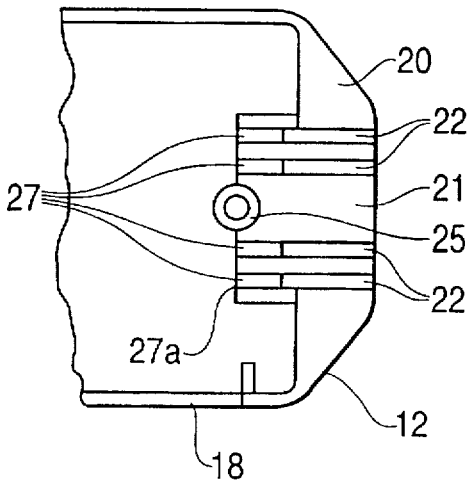
FIG. 3 is a plan view of the right-hand part of the lower casing portion.
Figure 4:
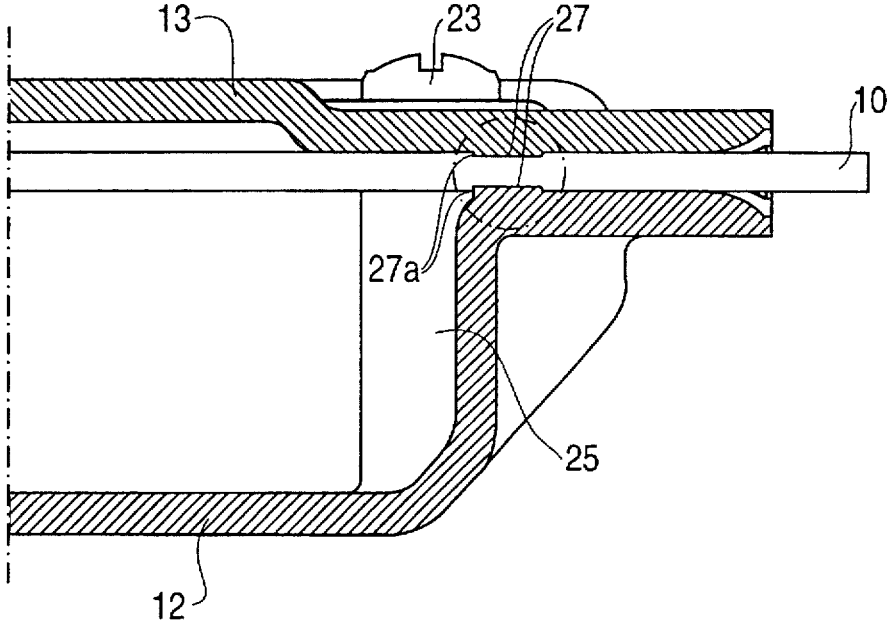
FIG. 4 is an enlarged longitudinal section through a part of the casing without the electrical equipment contained therein.

The manner in which the flat cable 10 is led into and out of the casing 14 is depicted in the right-hand portion of FIGS. 1 and 3, in the left-hand portion of FIG. 2 and, specifically, in FIG. 4. In these regions, the lower and upper casing portions 12 and 13 are formed as cramping regions for non-positively (by frictional force) engaging the flat cable 10 directly with the casing 14.

As is apparent from the representation in FIG. 4 with respect to the lower casing portion, and from FIG. 3, each casing portion 12, 13 in the lead-through region constitutes a support surface 21 for the cable 10, which support surface is offset from the parting plane 20 of the casing by somewhat more than half the thickness of the center web 28 of the cable 10. Four parallel grooves 22 are formed in the support surface 21 in registration with the wires 19 of the cable 10.

The support surface 21 extends from the end edge of the respective casing portion to the location where the casing portions 12, 13 are fixed to each other by means of a screw 23. The screw 23 extends though a hole 24 provided in the upper casing portion 13 and engages a screw receiving tube 25 integrally formed in the lower casing portion 12. The thread of the screw 23 and the diameter and material of the tube 25 are selected so that the screw 23 cuts its own thread in the tube.

The screw receiving tube 25 projects beyond the parting plane 20 of the casing 14 into an lower enlarged portion 26 of the hole 24 provided in the upper casing portion 13 and is so dimensioned that its end face abuts the bottom of the enlarged portion 26 when the screw 23 has been tightened to close the casing 14.

The grooves 22 provided in the support surface 21 have portions 27 of reduced depth at their inner ends, thus near the screw receiving tube 25 (in the lower casing portion shown in FIG. 3) and near the hole 24 (in the upper casing portion 13) thereby forming a restriction when the casing 14 is closed. This restriction is so dimensioned that the insulation of the wires 19 of the cable 10 is substantially pinched through and the casing portions squeeze the wires 19 substantially directly between the shallow portions 27. The casing portions 12, 13 are made of an insulating plastics material so that the penetration of the insulation at the portions 27 causes no problem.

As shown in FIGS. 1 and 5, the wires 19 are disposed in the flat cable 10 so as to leave a comparatively wide center web 28. A circular hole 29 is formed in this web 28 with a diameter only little larger than the outer diameter of the screw receiving tube 25. When the cable 10 is placed in the lower casing portion 12, the hole 29 is engaged by the tube 25 to form a positive engagement between the cable 10 and the casing 14, in addition to the non-positive engagement provided by the cramping region. At the same time, the relative position between the cable 10 and the printed circuit board 11 is fixed to such a degree that the soldering step may be carried out by an automatic apparatus. In the course of manufacture, punching of the holes 29 provided for each junction takes place in the same step as the stripping of the insulation in the intervening part for baring the wires 19 to be soldered to the printed circuit board.

The outer shape of the printed circuit board 11 is so that it fits snugly in the interior space of the lower casing portion 12. At either one of its end edges, the board 11 has a semicircular cut-out 30 (see FIG. 5) for engaging the respective screw receiving tube 25.

Further, the lower and upper casing portions 12, 13 each bear on the printed circuit board 11 through an approximately centrally located, integrally moulded spacer column 31, 32. The board 11 is thus held within the casing 14 by positive engagement. In an alternative embodiment, the two spacer columns 31, 32 may bear directly against each other within a hole (not shown) in the printed circuit board 11. In addition to positioning the board 11, the spacer columns 31, 32 serve to reinforce the casing 14.

In use, any tensile strain exerted on the cable 10 is transmitted to the casing 14, immediately at the location where the cable 10 enters the casing 14, by virtue of the cable being cramped between the support surfaces 21 and also by the screw receiving tube 25 engaging the hole 29 in the cable 10, bypassing the junction between the cable 10 and the printed circuit board 11, and at the exit from the casing 14, is transmitted, via the same elements, back to the remaining length of the cable 10.

As described above, maximum pinching pressure between the shallow portions 27 of the grooves 22 and the wires 19 of the cable 10 occurs in each cramping region in the immediate vicinity of the screw 23 which causes the cramp. In case any tensile strain becomes so high that the cable 10, in spite of the described measures, moves relatively to the casing 14, such movement will cause the insulation to dam up at edges 27*a* (FIG. 4) confining the shallow portions 27 of the grooves 22 within the casing 14, thereby increasing the resistance to relative movement between the cable 10 and the casing 14. Moreover, due to the plurality of bends in the wires 19 before and after the soldering points, certain relative movement will prevent the tensile strain from becoming sufficiently large to damage the soldering points.

As is shown particularly in FIGS. 1 and 2, the exterior profile of the casing 14 is shaped such that it has no free surfaces extending perpendicularly to the longitudinal direction of the cable. So far as perpendicular surfaces exist, they are offset behind chamfered faces and edges (compare the left-hand end of the lower casing portion 12 in FIG. 2). This feature prevents the casing 14 from becoming caught when the cable 10 is pulled over uneven ground, which would otherwise result in tensile strain.

The above description refers specifically to a cable for sequential blasting systems. It is similarly suited for other applications in which flat cables are provided with junctions.

We claim:

1. A casing for a junction in a flat cable, including two casing portions adapted to be fixed to each other and cooperating to form lead-through regions for the cable, each of said lead-through regions providing a cramping region for engaging said cable and securing said casing directly to said cable.

2. The casing of claim 1, wherein said two casing portions are adapted to be fixed to each other by screws which penetrate said cramping regions.

3. The casing of claim 2, wherein one of said casing portions includes screw receiving tubes, each of said screws passing through a first hole provided in another of said casing portions, a second hole provided in a web of the flat cable and engaging a respective one of said screw receiving tubes.

4. The casing of claim 3, wherein the hole provided in said other casing portion has an enlarged portion for receiving an end portion of the respective screw receiving tube.

5. The casing of claim 4, wherein said enlarged portion forms an abutment for an end face of the screw receiving tube.

6. The casing of claim 2, wherein each of said cramping regions has grooves formed in at least one of said casing portions for accommodating wires of said cable, each said groove having a shallow portion in the vicinity of said screw.

7. The casing of claim 6, wherein said shallow portion terminates inside the casing at an edge extending transversely to the longitudinal direction of said cable.

8. The casing of claim 1, having an outer profile free of surfaces extending transversely to the longitudinal direction of said cable.

9. The casing of claim 1, wherein said casing portions have internal spacer elements with ends contacting each other.

10. The casing of claim 1, including a printed circuit board placed in the casing in a positively engaging manner, said cable being fixed to said board and having a bent portion situated between each of said cramping regions and the location where it is fixed to said board.

11. The casing of claim 10, wherein said casing portions have internal spacer elements with ends engaging a printed circuit board.

12. A strain relief casing for a junction in a flat cable, the casing including two portions adapted to be fixed to each other and cooperating to form lead-through regions for the cable, each of the lead through regions providing a cramping region for engaging the cable and securing the casing directly to the cable.

* * * * *